US009216441B2

(12) United States Patent
Pacht

(10) Patent No.: US 9,216,441 B2
(45) Date of Patent: Dec. 22, 2015

(54) WATER JETTING GUN HAVING A REMOVABLE VALVE CARTRIDGE, AN ADJUSTABLE HAND GRIP AND AN ADJUSTABLE SHOULDER STOCK

(75) Inventor: Amos Pacht, Houston, TX (US)

(73) Assignee: GARDNER DENVER WATER JETTING SYSTEMS, INC., Houston, TX (US)

( * ) Notice: Subject to any disclaimer, the term of this patent is extended or adjusted under 35 U.S.C. 154(b) by 722 days.

(21) Appl. No.: 13/399,807

(22) Filed: Feb. 17, 2012

(65) Prior Publication Data

US 2012/0223163 A1 Sep. 6, 2012

Related U.S. Application Data

(60) Provisional application No. 61/448,109, filed on Mar. 1, 2011.

(51) Int. Cl.

| | |
|---|---|
| ***B05B 9/01*** | (2006.01) |
| ***B05B 12/00*** | (2006.01) |
| ***B08B 3/02*** | (2006.01) |
| *B05B 1/16* | (2006.01) |

(52) U.S. Cl.

CPC . *B08B 3/028* (2013.01); *B05B 9/01* (2013.01); *B05B 12/002* (2013.01); *B05B 1/1609* (2013.01); *Y10T 29/49815* (2015.01); *Y10T 29/49826* (2015.01)

(58) Field of Classification Search

CPC ..... B05B 9/01; B05B 12/002; B08B 3/028
USPC ..... 239/525, 526, 527, 600; 137/454.5, 137/454.6

See application file for complete search history.

(56) References Cited

U.S. PATENT DOCUMENTS

| | | | | |
|---|---|---|---|---|
| 3,885,739 | A * | 5/1975 | Tuttle | 239/124 |
| 4,593,858 | A * | 6/1986 | Pacht | 239/126 |
| 5,052,624 | A * | 10/1991 | Boers et al. | 239/525 |
| 5,349,982 | A | 9/1994 | Goldsmith | |

(Continued)

FOREIGN PATENT DOCUMENTS

| | | |
|---|---|---|
| DE | 93 00 881.3 | 1/1993 |
| DE | 202004019949 | 3/2005 |

(Continued)

OTHER PUBLICATIONS

Search report regarding Great Britain companion case GB1217243.3.

(Continued)

*Primary Examiner* — Ryan Reis
(74) *Attorney, Agent, or Firm* — Michael Best & Friedrich LLP

(57) ABSTRACT

An adjusting assembly adjustably coupling (1) a hand grip to a barrel of a water jetting gun or (2) a shoulder stock to a supply tube of a water jetting gun. The adjusting assembly includes a cam pin. The cam pin (1) couples to said grip and is proximate the barrel or (2) couples to the shoulder stock and is proximate the supply tube. A knob is rotatably coupled to the cam pin.

A water jetting gun has a body with an access port leading into a valve cartridge chamber. An adaptor extends through said access port. In the operable state, the adaptor is removable from the body by a person gripping a head of the adaptor with its hand and unscrewing the adaptor by hand without the aid of a hand tool.

8 Claims, 7 Drawing Sheets

(56) References Cited

U.S. PATENT DOCUMENTS

| | | | | |
|---|---|---|---|---|
| 5,423,348 | A | 6/1995 | Jezek | |
| 5,582,349 | A * | 12/1996 | Boisture | 239/124 |
| 5,636,789 | A | 6/1997 | Shook | |
| 5,904,297 | A | 5/1999 | Kendrick, Jr. et al. | |
| 5,975,429 | A | 11/1999 | Jezek | |
| 6,412,516 | B1 * | 7/2002 | Goldsmith | 137/454.6 |
| 6,431,214 | B1 | 8/2002 | Herhold | |
| 6,499,510 | B2 | 12/2002 | Herhold | |
| 6,880,767 | B2 | 4/2005 | Herhold | |
| 2002/0079383 | A1 | 6/2002 | Forrest | |
| 2002/0112769 | A1 | 8/2002 | Herhold et al. | |
| 2004/0161351 | A1 | 8/2004 | Forrest | |

FOREIGN PATENT DOCUMENTS

| | | | |
|---|---|---|---|
| EP | 1 447 181 | A1 | 8/2004 |
| GB | 2 203 363 | A | 10/1988 |

OTHER PUBLICATIONS

Jetstream document (acknowledged as prior art), 1998, Jetsream of Houston, Inc.

Figures 1 through 2B acknowledged prior art.

Examination report from DE companion case, DE 10 2012 203 048.4.

English language machine translation of examination report from DE companion case, DE 10 2012 203 048.4.

English language machine translation of the specification and claims of cited reference G 93 00 881.3.

UK search report in connection with related case GB1203579.6.

Machine translation for DE202004019949.

Hand Lances (286 Series), (acknowledged as prior art), p. 12.

* cited by examiner

WATER JETTING GUN HAVING A REMOVABLE VALVE CARTRIDGE, AN ADJUSTABLE HAND GRIP AND AN ADJUSTABLE SHOULDER STOCK

FIELD OF INVENTION

The present invention concerns a water jetting gun having a valve cartridge removable from a gun body; the gun also has an adjustable hand grip and an adjustable shoulder stock.

BACKGROUND

Water jetting guns are known. One type of water jetting gun, also called a hand lance, has a dump tube. U.S. Pat. No. 5,349,982 discloses a water jetting gun having a dump tube. The gun has a gun housing or block. A valve cartridge is maintained within a valve chamber of the block. To service the valve cartridge inside the block, one must remove a dump adaptor from the block with a hand tool such a crescent wrench. One would use a hand tool to tighten the adaptor to the block to ready the gun for operation.

U.S. Pat. No. 5,636,789 also discloses a water gun with a dump tube. The gun has a shoulder support which is adjustable. The gun has a valve cartridge assembly which is removable from a housing with a hand tool. The hand tool couples with a hex head of the valve cartridge. One would use a hand tool to tighten the cartridge to the housing to ready it for operation.

Prior art FIGS. 1A-1B disclose a handle assembly 10 for a 15,000 psi water jetting gun. The handle assembly is configured for use with a dump tube 12. See FIG. 2B. The assembly has a body 14 which can be called a gun housing or a gun block. The body or housing holds a valve cartridge assembly 16 in a valve chamber 18 defined by the block 14. The chamber 18 has an access port 20 sealed off by an adaptor 22. The adaptor 22 is coupled to the valve cartridge 16 at a coupling end 23 of the adaptor. The coupling end 23 is threadably engaged to the block 14. The adaptor has a hex head 24 which rises above the block's external surface 26. The head 24 is configured for coupling to a hand tool such as a crescent wrench. An operator may remove the adaptor 22 and valve cartridge 16 coupled thereto by untightening the adaptor 22 from the block 14. The operator will use a hand tool. The operator would then lift the adaptor 22 by hand away from the block 14. The cartridge 16 is removed with the adaptor 22. When readied for operation, the adaptor 22 with the cartridge 16 is tightened to the body with a hand tool to a torque of between 10 IN·LB and 50 IN·LB.

As seen in prior art FIGS. 2A-2B a supply tube 28 is threadably engaged to a supply conduit 30 passing through the block 14 at a first end 31 of the conduit 30. The supply tube 28 carries a shoulder stock 32. The shoulder stock 32 is adjustably coupled to the supply tube 28 by way of a cam stud 34. The cam stud 34 is loosened and tightened by a hand tool. When loosened the stock 32 may be adjusted back and forth along the length of the supply tube 28.

A barrel 36 which can also be called a nipple is threadably engaged with the supply conduit 30 at a second end 33. The barrel 36 carries a hand grip 38. The hand grip is also adjustably coupled to the barrel 36 by way of a cam stud 40. The cam stud 40 is loosened and tightened with a hand tool. When loosened, the grip may be adjusted back and forth along the length of the barrel.

SUMMARY

One aspect of the invention concerns an adjusting assembly adjustably coupling (1) a hand grip to a barrel of a water jetting gun or (2) a shoulder stock to a supply tube of a water jetting gun. The adjusting assembly includes a cam pin having a cut out portion. The cam pin (1) couples to said grip and is proximate the barrel or (2) couples to the shoulder stock and is proximate the supply tube. A knob is rotatably coupled to the cam pin.

Another aspect of the invention concerns an assembly of a water jetting gun. The assembly has a body, a valve cartridge in a valve cartridge chamber of the body, an access port leading into the valve cartridge and an adaptor extending through said access port. The portion of the adaptor extending through the access port has threads engaged to the body. A head is formed by the adaptor. The head is above the body. The water jetting gun is in an operable state ready to be used without further tightening of the adaptor. The adaptor is removable from the body by a person gripping the head with its hand and unscrewing the adaptor by hand without the aid of a hand tool.

A further aspect of the invention includes a method for removing an adaptor from an access port of a water jetting gun. The method includes providing a water jetting gun in an operable state ready to be used without further tightening of an adaptor. The adaptor is threadably engaged to a body. The head of the adaptor is gripped by the hand of a person. The adaptor is unscrewed by the hand without the aid of the hand tool. The adaptor is removed from the access port.

The invention includes further methods, assemblies and features which are further described below in the detailed description and the attached drawings.

DETAILED DESCRIPTION

Figure 1A:
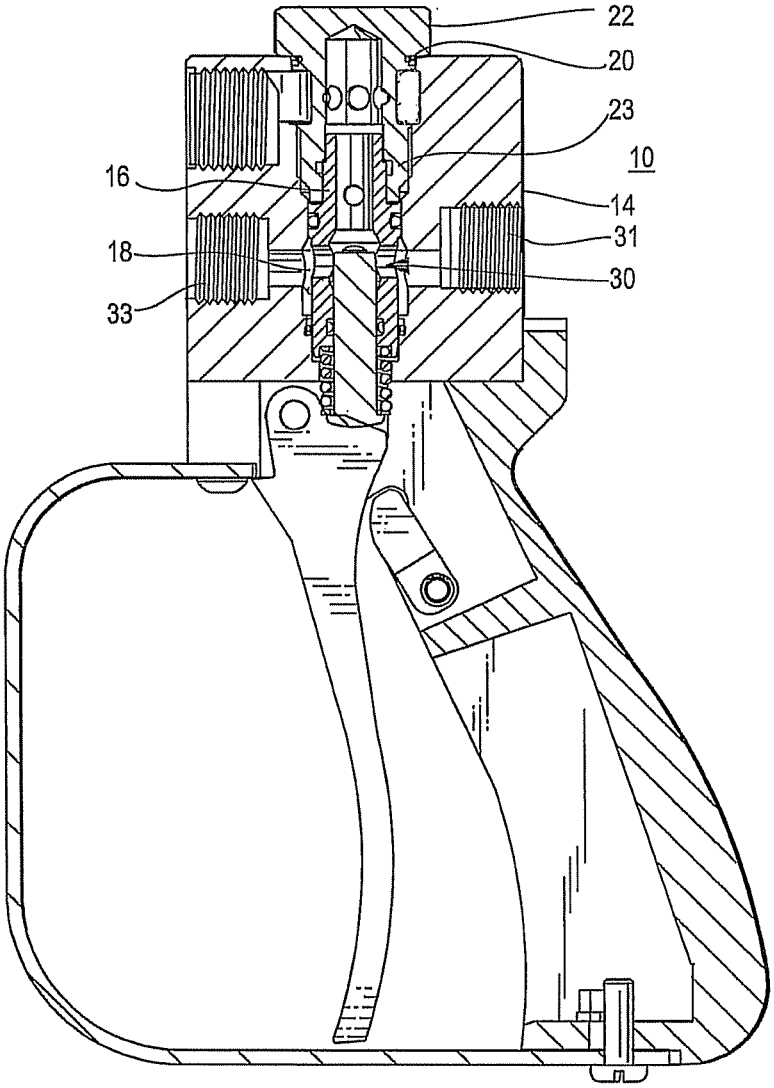
FIG. 1A is a sectional view of handle assembly of a prior art water jetting gun.
Figure 1B:
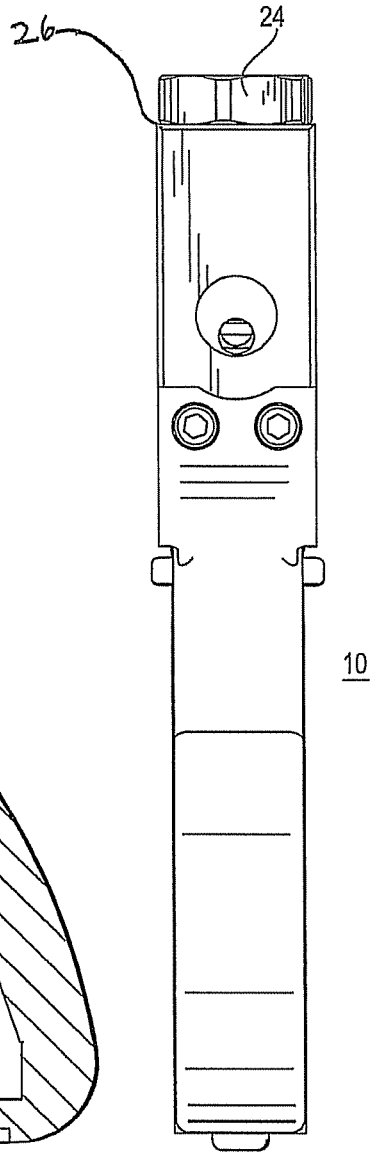
FIG. 1B is a rear view of the assembly shown in FIG. 1A.
Figure 2A:
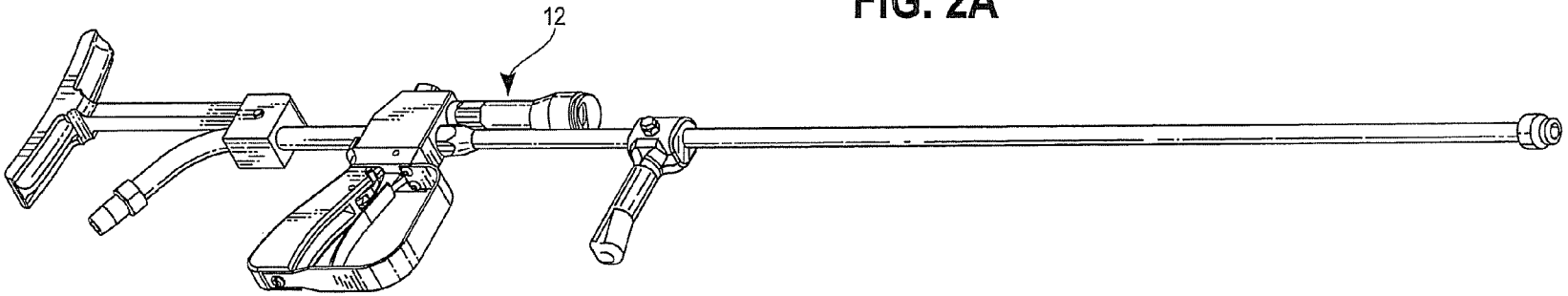
FIG. 2A is a perspective view of a prior art water jetting gun.
Figure 2B:
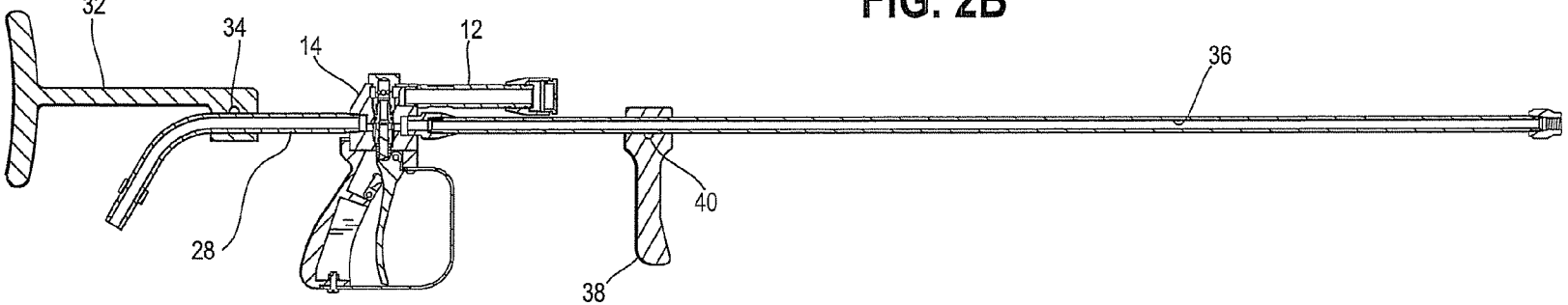
FIG. 2B is a sectional view of the water jetting gun shown in FIG. 2A.
Figure 3A:
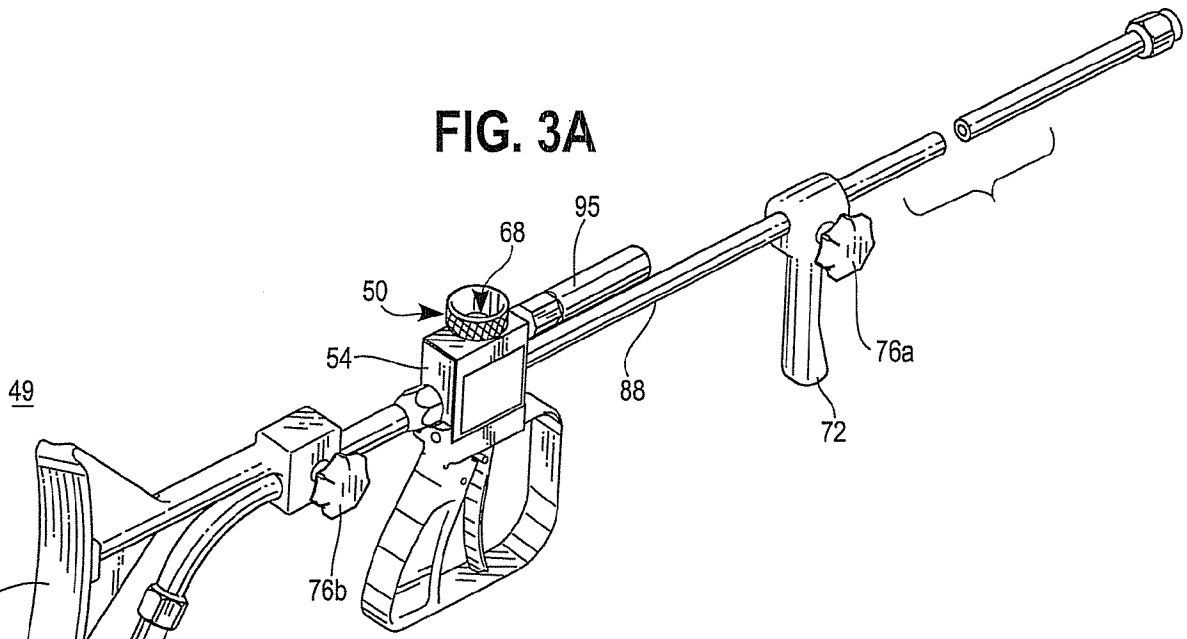
FIG. 3A is a perspective view of a water jetting gun embodying the features of the present invention.
Figure 3B:
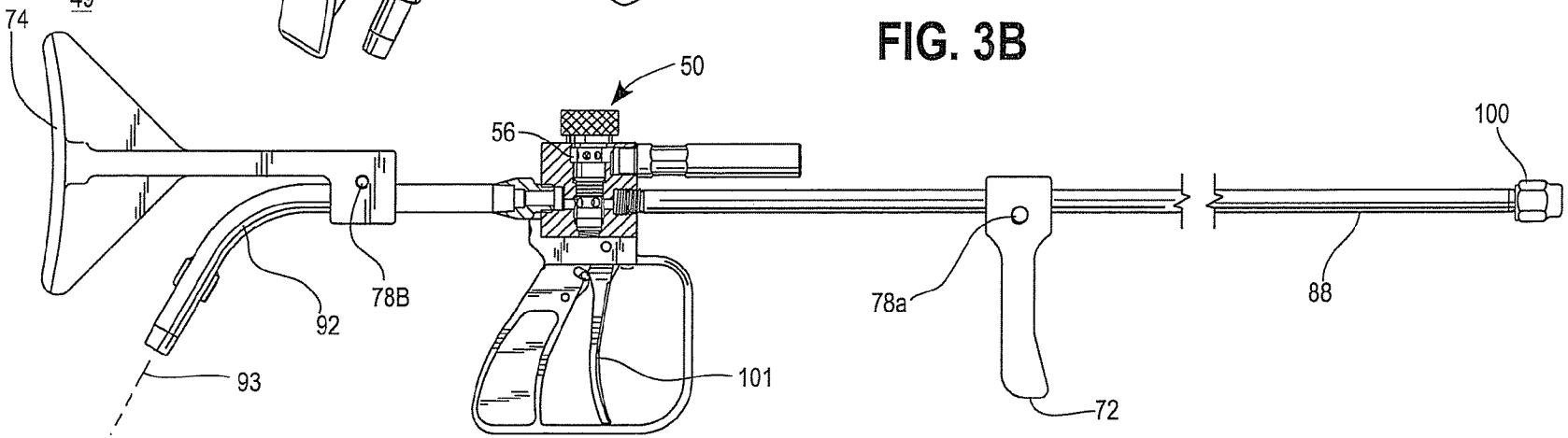
FIG. 3B is a side view of the gun shown in FIG. 3A wherein a portion of the gun's block has been sectioned away.
Figure 4:
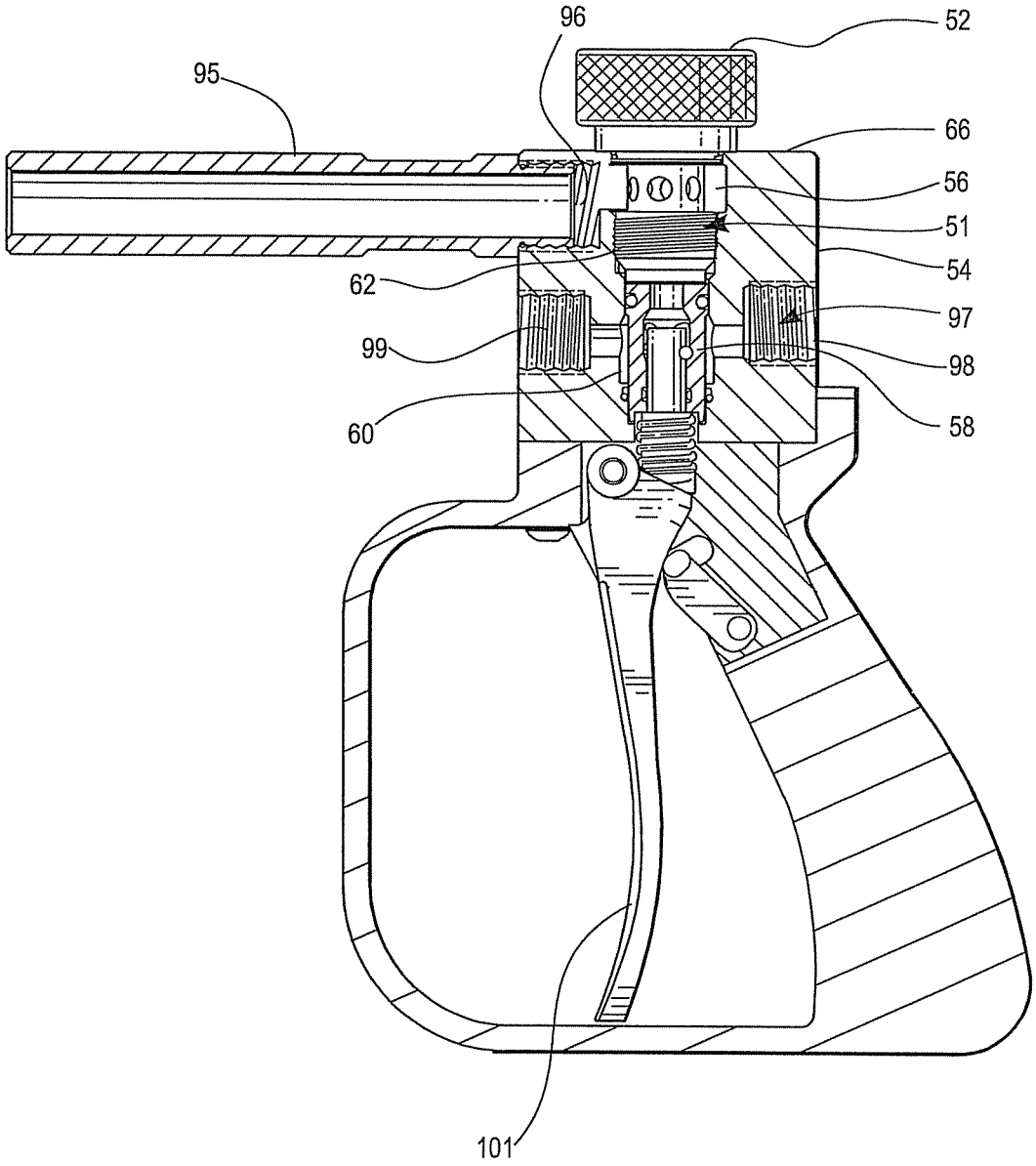
FIG. 4 is a partial sectional view of the hand assembly of the gun shown in FIG. 3A.

FIGS. 3A-4 disclose a water jetting gun embodying the invention. The gun receives and discharges water in the same way as the prior art gun as shown in FIGS. 1A-2B. The gun 49, however, has an adaptor 50 with a head 52 sized to be gripped and turned by the hand of an operator or servicer as opposed to a hand tool. When the gun is assembled and in an operable state, the adaptor 50 has been tightened by the hand of an operator gripping the head. It is tightened to the block 54 with a torque obtainable by hand gripping the head as opposed to a hand tool. The torque can be as little as 1 IN·LB. The gun is ready for use without further tightening. Applicant has surprisingly discovered that the adaptor 50 can properly seal off the access port 56 by being tightened by hand with a torque of no more than 5 IN·LB. This runs true for guns designed to create pressures from 15,000 psi up to 40,000 psi. Previously it was believed that a hand tool was needed to inpart a torque of at least 50 IN·LB on these guns.

In more detail the gun's block, housing or body 54 holds a valve cartridge 58 in a valve chamber 60 defined by the block 54. The chamber 60 has its access port 56 sealed off by the adaptor. The adaptor is coupled to a valve cartridge 58 at a coupling end 51 of the adaptor 50. Threads 62, proximate coupling end 51, threadably engage the adaptor to the block. The head 52 of the adaptor rises above the blocks external surface 66 and access port 56. The adaptor 50 is removed from the block 54 by gripping the head 52 by hand and rotating the adaptor in a loosening direction with the hand. Rotation loosens the adaptor 50 from the block 54. The adaptor 50 with the cartridge 58 coupled thereto can then be removed from the block by hand without the aid of a hand tool. The removal can be done without tools and from a gun in a fully operable state, i.e., the gun is ready to be used without further tightening of the adaptor.

Once removed the cartridge 58 can be inspected and serviced or replaced. To reinstall or install the cartridge into the block 54, the cartridge 58 is coupled to the adaptors 50 coupling end 51. The cartridge 58 and coupling end 51 are inserted into the valve chamber 60 via the access port 56. The operator then, by its hand gripping the head, tightens the adaptor 50 to the block 54 with a torque obtainable by hand without the use of a hand tool. The torque can be as little as 1 IN·LB. The gun 49 is then in operable condition ready for use.

The head 52 of the adaptor has a circumferential side wall 67 bounding an open space 68. The head includes a floor 69 bounded by the circumferential wall 67. The floor 69 has a conical recess 70. The wall has knurling on its outer surface. The circumferential wall has an outer diameter of 1.75 IN.

The adaptor 50 has a shoulder 150 beneath the head 52. The shoulder abuts up against the block 54. Formed within the adaptor beneath the shoulder is an o-ring receiving groove 151. When fit with an o-ring, the o-ring seals against the block.

The water jetting gun in FIGS. 3A, 3B embodying the invention also differs from the prior art in how the hand grip 72 and shoulder stock 74 are enabled to be adjusted. An operator may adjust the location of the hand grip and shoulder stock on the gun and then affix in place the shoulder stock and hand grip without the use of hand tools. To enable the adjustment, the grip and shoulder stock each are outfitted with an adjusting assembly. Each assembly includes a knob 76*a* or 76*b* configured to be gripped by hand. The assembly also includes a uniquely configured cam pin 78*a* or 78*b* which can also be called a stud or lug.

The cam pin 78*a* or 78*b* is threaded at one end to receive a threaded end of the knob. The cam pin, along a portion of its axial length, is cut out. The surface 80*a* or 80*b* of the cut out portion, starting from one end of the cut out portion, forms a downwardly sloping incline. A cross sectional profile of the inclined surface appears as a ramp. The incline is gradual. It is between 10 to 20 degrees measured from a horizontal, parallel to the cam's axis. The surface 82*a* or 82*b* of the cut out portion, at an end opposite the end with the gradual incline, is arcuate and has a central angle. Another surface 84*a* or 84*b* forming the cut out portion is parallel to the cam's axis. It extends between the inclined surface 80*a* or 80*b* and the arcuate surface 82*a* or 82*b*.

Figure 5A:
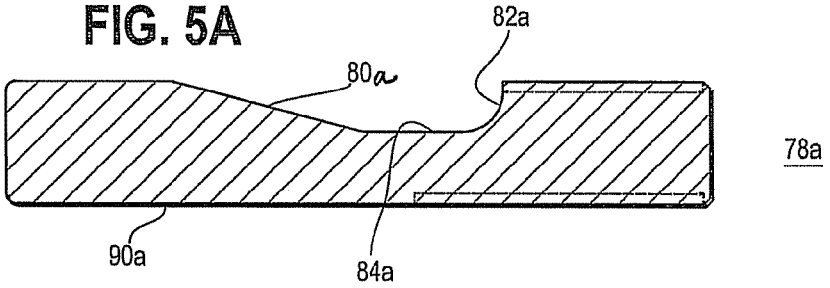
FIG. 5A is a sectional view of the cam pin holding the grip shown in FIG. 3.
Figure 5B:
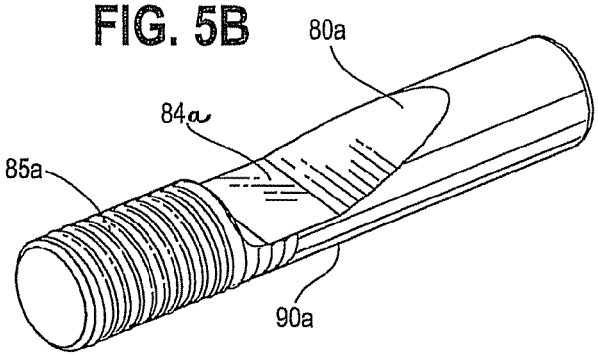
FIG. 5B is a perspective view of the pin shown in FIG. 5A.
Figure 5C:
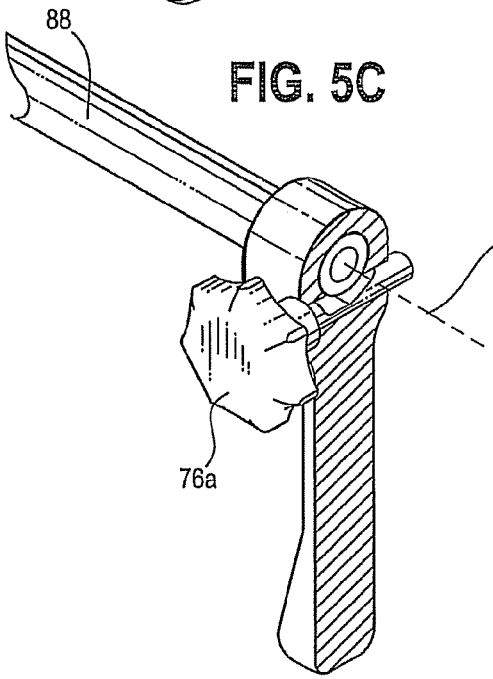
FIG. 5C is a partial sectional view showing the pin of FIG. 5A as part of an adjusting assembly holding the grip in place to the barrel of the water jetting gun of FIG. 3B.
Figure 5D:
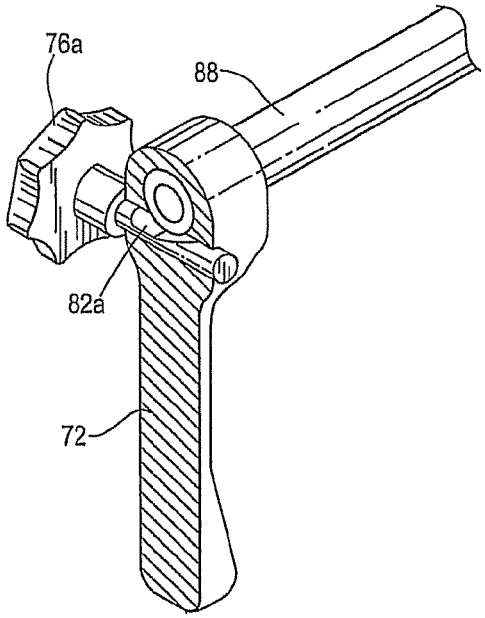
FIG. 5D is an alternative view of the assembly shown in FIG. 5C.
Figure 6A:
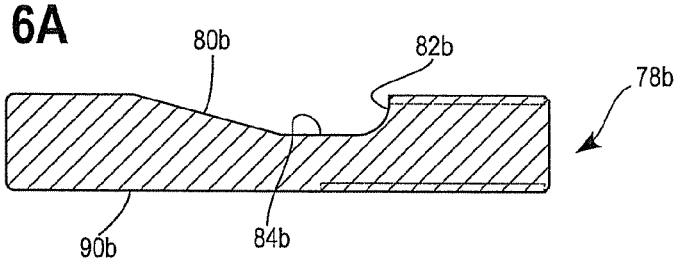
FIG. 6A is sectional view of the cam pin holding the stock shown in FIG. 3.
Figure 6B:
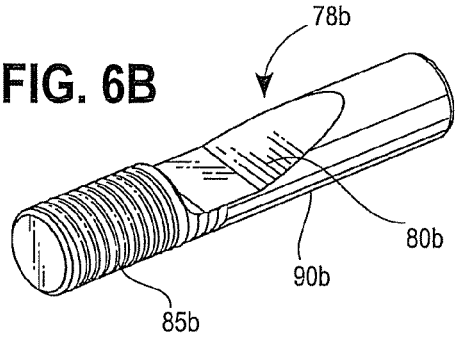
FIG. 6B is a perspective view of the pin shown in FIG. 6A.
Figure 6C:
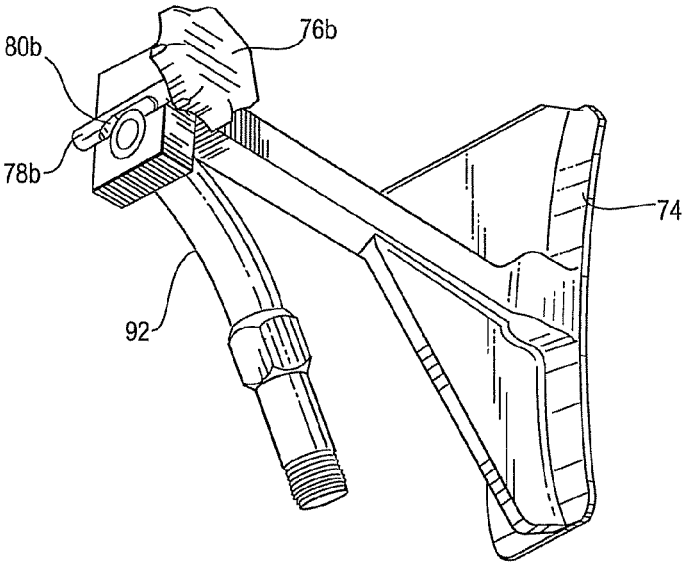
FIG. 6C is a partial sectional view showing the pin of FIG. 6A as part of an adjusting assembly holding the stock in place to the supply tube of the water jetting gun of FIG. 3B.
Figure 6D:
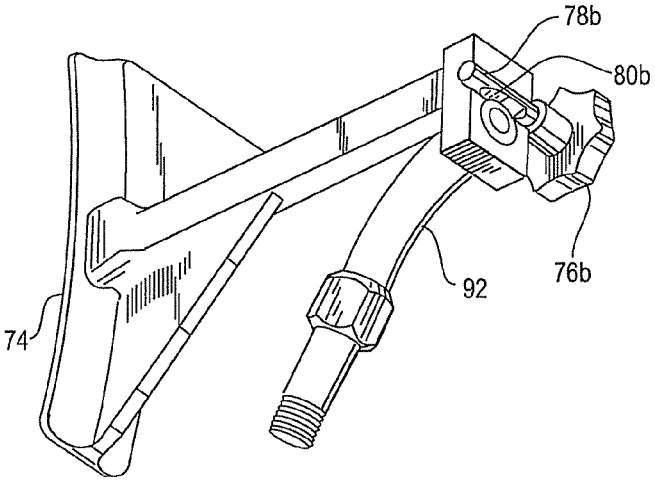
FIG. 6D is an alternative view of the assembly shown in FIG. 6C.
Figure 7A:
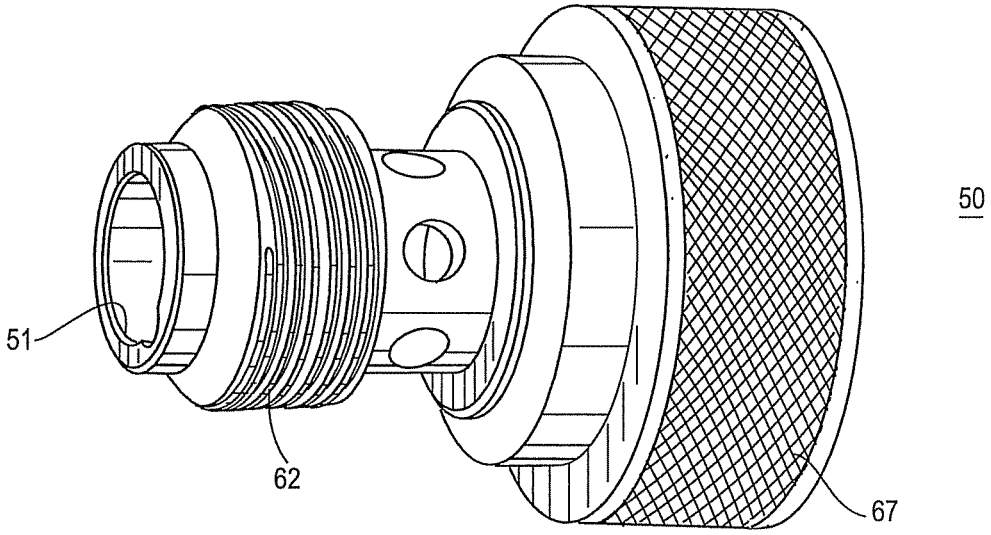
FIG. 7A is a perspective view of the adaptor of the gun shown in FIG. 3B.
Figure 7B:
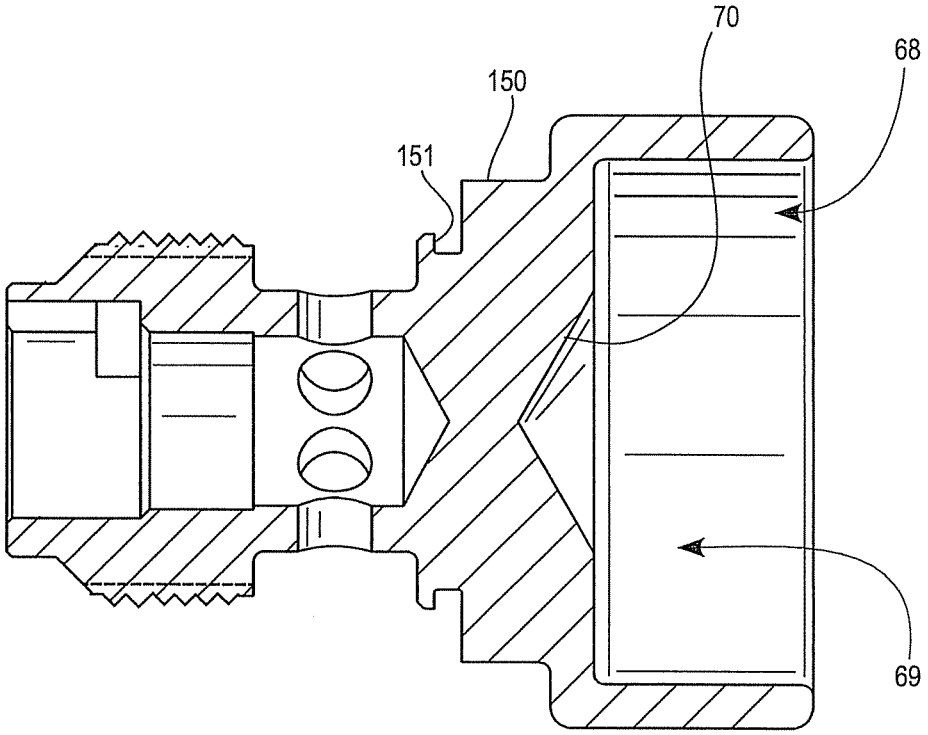
FIG. 7B is a sectional view of the adaptor shown in FIG. 7A.

The grip 72 coupled to the adjusting assembly has a first orientation wherein the grip can be slidably moved back and forth along the length of the barrel. The grip has a second orientation where the grip is fixedly coupled to the barrel. See FIGS. 5C, 5D. It is no longer slidably movable relative to the barrel. An operator to orient the grip from the first orientation to the second orientation turns the knob 76*a* clockwise in a first direction. Turning the knob in the first direction moves pin 78*a* axially towards the knob 76*a* by virtue of the threading 85*a* in the pin and in the knob 76*a*. As the pin moves, the inclined surface 80*a* moves closer to the knob 76*a*. As the pin moves closer to the knob, the higher part of the inclined surface moves closer to the axis 86 of the barrel 88. As the taller part of the inclined surface moves towards the axis 86, the pin 78*a* exerts an increasingly strong wedge like force. The pin's inclined portion 80*a* exerts a force against the barrel, and the surface opposite 90*a* the inclined surface, exerts a force against the grip. The force, when the grip is in the second orientation, is strong enough to keep the grip in place. Accordingly, when the grip is in the second orientation, the inclined surface 80*a* is closer to the knob than when it is in the first orientation. Indeed the parallel surface 84*a*, and the arcuate surface 82*a* are also closer to the knob in the second orientation as opposed to the first orientation.

The stock 74 also has a first orientation wherein the stock 74 can be slidably moved back and forth along the length of the supply tube 92. The stock has a second orientation where the stock is fixedly coupled to supply tube 92. It is no longer slidably movable relative to the shoulder stock. An operator to orient the stock 74 from the first orientation to the second orientation turns knob 76*b* clockwise in a first direction. Turning the knob 76*b* in the first direction moves pin 78*b* axially towards the knob 76*b* by virtue of the threading 85*b* on the pin 78*b* and in the knob 76*b*. As pin 78*b* moves, the inclined surface 80*b* moves closer to the knob. As the pin moves closer to the knob, the taller part of the inclined surface 80*b* moves closer to the axis 93 of the supply tube. As the taller part of the inclined surface 80*b* moves towards the axis, the pin 78*b* exerts an increasingly strong wedge like force. The pin's inclined portion 80*b* exerts a force against the supply tube 92, and the surface opposite 90*b* the inclined surface, exerts a force against the stock. The force, when the stock is in the second orientation, is strong enough to keep the stock in place. Accordingly, when the stock is in the second orientation the inclined surface 80*b* is closer to the knob 76*b* than when it is in the first orientation. Indeed the parallel surface 84*b* and the arcuate surface 82*b* are also closer to the knob in the second orientation as opposed to the first orientation.

To adjust the 72 grip or stock 74 from the second orientation to the first orientation an operator or servicer turns knob 76*a* or 76*b* with his hand in a second direction opposite the first direction. The pin 78*a* or 78*b* moves axially away from the knob. The operator also pushes the knob towards the member being adjusted (grip or stock). If the grip 72 is being adjusted to the first orientation, the base of the pin's inclined surface 80*a* moves away from the side of the barrel closest to the knob. The arcuate surface 82*a* and parallel surface 84*a* move towards the barrels central axis. The wedge force between the barrel 88 and grip 72 is now reduced and the grip is free to move along the length of the barrel. If the stock 74 is being adjusted to the first orientation, the base of the pin's inclined surface 80*b* moves away from the side of the supply tube 92 closest to the knob 76*b*. The arcuate surface 82*b* and parallel surface 84*a* move towards the supply tubes central axis 93. The wedge force between the supply tube 92 and stock 74 is now reduced and the stock 74 is free to move along the supply tube 92.

The water jetting gun which embodies the present invention has other features. A supply conduit 97 passing through the block is fluidly coupled to the valve chamber 60 and intersects the valve chamber 60. A water dump conduit is also fluidily coupled to the valve chamber and intersects the chamber. The supply conduit 97 is threaded at both ends.

As seen in FIGS. 3A and 4 a dump tube 95 is threadably engaged with the dump conduit 96. The supply tube 92 is threadably engaged with the supply conduit 97 at a first end 98. The barrel 88, which can also be called a nipple, is threadably engaged with the supply conduit 97 at the second end 99. A nozzle holder 100 is at the end of the barrel 88. When the gun's trigger 101 is actuated, and the gun 49 is connected to a flowing water source, water enters the gun from the supply tube 92. It passes through the supply conduit 97, enters the barrel 88 and exits the barrel through a nozzle (not shown) held by the nozzle holder 100. When the trigger is not activated water exits the gun from the dump tube 95.

Although a preferred embodiment has been shown and described it will be appreciated by those skilled in the art that various changes and modifications might be made without departing from the scope of the invention, as defined in the appended claims.

All of the features disclosed in the specification (including any accompanying claims, abstract and drawings), and/or all of the steps or any method or process disclosed may be combined in any combinations where at least some of the features and/or steps are mutually exclusive.

Each feature disclosed in the specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment. The invention extends to any novel, or any novel combination, of the features disclosed in the specification (including any accompanying claims, abstract and drawing), or to any novel, or any novel combination, of the steps of any method or process so disclosed.

I claim:

1. An assembly of a water jetting gun, said assembly comprising:

a body, said body having a valve cartridge chamber;

a valve cartridge in said valve cartridge chamber;

an access port leading into said valve cartridge chamber;

an adaptor having a portion extending through said access port, said portion extending through having threads, said threads threadably engaged to said body;

a head formed by said adaptor, said head above said body;

a supply conduit in fluid connection with said valve cartridge chamber; and an adjusting assembly adjustably coupling (1) a hand grip to a barrel of said water jetting gun or (2) a shoulder stock to a supply tube of said water jetting gun, said adjusting assembly including a cam pin having a cut out portion delimiting a space, said cut out portion including a downwardly sloping inclined surface, said downwardly sloping inclined surface starting to slope downwardly from an end of said cut out portion;

an arcuate surface, said arcuate surface at an other end of said cut out portion opposite the inclined surface, and a surface parallel to an axis of said cam pin, said surface parallel to an axis of said cam pin extending between the inclined surface and the arcuate surface, and a knob rotatably coupled to said cam pin, wherein said knob is rotatable relative to said cam pin, wherein said water jetting gun is in an operable state ready to be used without further tightening of said adaptor, wherein said cam pin is (1) coupled to said hand grip and said barrel in said space delimited by said cut out portion or (2) coupled to said shoulder stock and said supply tube in said space delimited by said cut out portion, wherein said adaptor is removable from said body by a person gripping said head with a hand of said person and unscrewing said adaptor with said hand when said water jetting gun is ready to be used without further tightening of said adaptor, and wherein removal of the valve cartridge can be done by hand without the aid of a hand tool when said gun is ready to be used without further tightening of said adaptor.

2. The assembly of claim 1 wherein said head is sized to be gripped by the hand of an operator and turned by the hand.

3. The assembly of claim 1 wherein the water jetting gun is capable of creating pressures greater than or equal to 15,000 PSI.

4. The assembly of claim 1 wherein said knob is arranged in a plane that is perpendicular to the axis of the cam pin, wherein a farthest distance between any two points on the knob within the plane is at least 1.5 inches.

5. The adjusting assembly of claim 1 wherein said downwardly inclined surface exerts a first force against said barrel, and a surface of the cam pin opposite the inclined surface exerts a second force against a grip, said first and second forces being strong enough to keep said grip in place relative to said barrel during normal operation of said water jetting gun.

6. The adjusting assembly of claim 5 wherein said downwardly inclined surface exerts a third force against said supply tube, and a surface of the cam pin opposite the downwardly inclined surface exerts a fourth force against said shoulder stock, said third and fourth forces strong enough to keep said shoulder stock in place relative to said supply tube during normal operation of said water jetting gun.

7. The adjusting assembly of claim 1 wherein said hand grip has a first orientation wherein the hand grip can be moved back and forth along a portion of a length of the barrel, wherein the hand grip has a second orientation wherein the hand grip cannot be moved back and forth along the portion of the length of the barrel, wherein the hand grip is in the second orientation and, wherein the knob may be turned in an unscrewing direction relative to said cam pin coupled to said hand grip by said person gripping said knob and turning said knob by said hand of said person.

8. The adjusting assembly of 1 wherein said shoulder stock has a first orientation wherein the shoulder stock can be moved back and forth along a portion of a length of the supply tube, wherein the shoulder stock has a second orientation wherein the shoulder stock cannot be moved back and forth along the portion of the length of the supply tube, wherein the shoulder stock is in the second orientation, and wherein the knob may be turned in an unscrewing direction relative to said cam pin coupled to said shoulder stock by said person gripping said knob and turning said knob by said hand of said person.

* * * * *